US008371731B2

(12) United States Patent
Zanma

(10) Patent No.: US 8,371,731 B2
(45) Date of Patent: Feb. 12, 2013

(54) VEHICLE LAMP

(75) Inventor: Yasuyuki Zanma, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 320 days.

(21) Appl. No.: 12/891,792

(22) Filed: Sep. 27, 2010

(65) Prior Publication Data

US 2011/0075436 A1 Mar. 31, 2011

(30) Foreign Application Priority Data

Sep. 25, 2009 (JP) ..... 2009-220843

(51) Int. Cl.
*F21V 7/00* (2006.01)

(52) U.S. Cl. .... 362/516; 362/517; 362/518; 362/296.08

(58) Field of Classification Search ..... 362/516, 362/517, 518, 296.08
See application file for complete search history.

(56) References Cited

U.S. PATENT DOCUMENTS

| | | | | |
|---|---|---|---|---|
| 5,927,848 | A | 7/1999 | Natsume et al. | |
| 6,152,589 | A * | 11/2000 | Kawaguchi et al. | 362/518 |
| 2003/0174509 | A1 * | 9/2003 | Futami | 362/517 |
| 2004/0052085 | A1 * | 3/2004 | Tanaka et al. | 362/516 |
| 2008/0278961 | A1 * | 11/2008 | Cunnien | 362/516 |

FOREIGN PATENT DOCUMENTS

JP 9-136571 A 5/1997

* cited by examiner

*Primary Examiner* — Evan Dzierzynski
(74) *Attorney, Agent, or Firm* — Kenealy Vaidya LLP

(57) ABSTRACT

A vehicle lamp can include a light source, a reflector and a lens. The reflector can be formed in a slender shape so as to include a parabolic reflex surface in a longitudinal direction and an ellipsoidal reflex surface in a direction substantially perpendicular to the longitudinal direction. A focus of the parabolic reflex surface and one of the focuses of the ellipsoidal reflex surface can be located at the light source, and other focuses of the ellipsoidal reflex surface can be substantially parallel with a central axis of the lens. The reflector can reflect light emitted from the light source toward the lens with a wide angle so that light use efficiency of the light source can improve as compared with certain conventional vehicle lamps. Thus, the vehicle lamp can provide a favorable light distribution even when it is formed in a slender shape.

20 Claims, 13 Drawing Sheets

VEHICLE LAMP

This application claims the priority benefit under 35 U.S.C. §119 of Japanese Patent Application No. 2009-220843 filed on Sep. 25, 2009, which is hereby incorporated in its entirety by reference.

BACKGROUND

1. Field

The presently disclosed subject matter relates to a vehicle lamp, and more particularly to a vehicle signal lamp such as a tail lamp, a stop lamp and the like, which can provide a favorable light distribution pattern even when it is formed in a slender shape.

2. Description of the Related Art

A vehicle signal lamp such as a tail lamp, stop lamp, turning lamp, marking lamp. spot lamp, and the like is typically attached to a rear (but can be attached to a front or side) of a vehicle to inform other drivers about a driving state of the vehicle. Accordingly, the vehicle signal lamp has typically been formed to include a large light-emitting surface so that other drivers can easily confirm the driving signal. However, the rear of the vehicle may not be generally large because it is preferable to maintain a large rear window for safe driving. Therefore, the vehicle signal lamp tends to become a long and thin shape in a horizontal/vertical direction. In addition, it may be desirable to reduce a depth of the vehicle signal lamp so that the vehicle can maintain a large space for a trunk or for design criteria.

A conventional vehicle lamp such as a high mount stop lamp is disclosed in patent document No. 1 (Japanese Patent Application Laid Open H09-136571). FIGS. 13*a* and 13*b* are a horizontal and vertical cross-section view depicting a structure for the conventional high mount stop lamp. The conventional vehicle lamp of FIGS. 13*a* and 13*b* includes: a lamp body 60 including an opening; a lens 61 attached to the opening of the lamp body 60; and a bulb 62 located in the lamp body 60 and adjacent the lens 61.

The lamp body 60 includes: a rear surface portion 63 including a reflex surface 66 on an inner surface thereof; a top surface portion 64 connecting to the rear surface portion 63; and a bottom surface portion 65 connecting to the rear surface 65 so as to expand from the lens 61 toward the rear surface portion 66 in a vertical direction as shown in FIG. 13*b*. The reflex surface 66 is formed in a parabolic shape in a horizontal direction and is formed as a collecting surface having a shape such as a circular shape, an ellipsoidal shape and the like in the vertical direction.

The bulb 62 is attached to the bottom surface portion 65 of the lamp body 60 so that a filament of the bulb 62 is located at a focus of the reflex surface 66, which is located on an optical axis X of the parabolic shape in the horizontal direction and is located at a first focus of the ellipsoidal surface in the vertical direction. The lens 61 includes an inner surface 67 and an outer surface 68, and forms a fisheye lens with the inner and outer surfaces.

In the structure of the conventional vehicle lamp, a direct light L1 emitted from the bulb 62 may enter into the lens 61. A reflected light L2 that is emitted from the bulb 62 and is reflected on the reflex surface 66 may pass in a direction parallel with the optical axis X in the horizontal direction and may pass so as to converge in the vertical direction, and the reflected light L2 may enter into the lens 61.

The lights L1 and L2 are emitted in a direction toward a light-emission of the vehicle lamp via the lens 61 while they are focused by the lens 61. Therefore, the conventional vehicle lamp can emit the light L1 and L2 with a wide range using the lens 61 and the reflex surface 66, which are formed in a wide and thin shape.

The above-referenced Patent Document is listed below and is hereby incorporated with its English abstract in its entirety.

1. Patent document No. 1: Japanese Patent Application Laid Open H09-136571

However, in the above-described structure of the conventional vehicle lamp, though the bulb 62 is located at the first focus of the ellipsoidal surface in the vertical direction, a second focus of the ellipsoidal surface may not be determined. Accordingly, a focus point of the reflected light L2 may not be determined, and a direction of each the light rays that pass through the lens 61 may not be determined. Therefore, because it is difficult for the conventional structure to control a light distribution, it may be difficult for the conventional vehicle lamp to realize a desired light distribution pattern.

In addition, because the bulb 62 is attached to the bottom surface portion 65 of the lamp body 63, a height of the rear surface portion 63 may become high as compared with that of the lens 61. Thus, an attachment structure of the conventional vehicle lamp may become complex, and a light use efficiency of the vehicle lamp may not be high.

The disclosed subject matter has been devised to consider the above and other problems, characteristics and features. Thus, an embodiment of the disclosed subject matter can include a vehicle lamp having a favorable light distribution even when a lens and a reflector are formed in a long and thin shape. In this case, various light sources such as a semiconductor light source, an HID lamp, a halogen bulb and the like can be employed as a light source with a simple structure and substantially the same structure.

SUMMARY

The presently disclosed subject matter has been devised in view of the above and other characteristics, desires, and problems in the conventional art, and to make certain changes to existing vehicle lamps. Thus, an aspect of the disclosed subject matter includes providing a vehicle lamp having a favorable light distribution with high light use efficiency even when a lens and a reflector are formed in a long and thin shape. In this case, various light sources such as a light bulb, a semiconductor light source and the like can be used as a light source with a simple structure and basically the same structure. Another aspect of the disclosed subject matter includes providing a vehicle signal lamp which can provide a favorable light distribution with high light use efficiency even when it is incorporated in a long and thin space of a vehicle.

According to an aspect of the disclosed subject matter, a vehicle lamp can include a reflector having a first focus, a second focus line, and an opening that is formed in a slender or elongate shape, a light source having an optical axis and a lens having a central axis in the longitudinal direction of the reflector. The reflector can be formed in a slender shape so as to include a parabolic reflex surface in a longitudinal direction and an ellipsoidal reflex surface in a direction substantially perpendicular to the longitudinal direction. A focus of the parabolic reflex surface and one of the focuses of the ellipsoidal reflex surface can be located at the first focus of the reflector, and other ones of the focuses of the ellipsoidal reflex surface can be located on the second focus line of the reflector. The light source can be located at the first focus of the reflector, and the lens can be located at the opening of the reflector, wherein the second focus line of the reflector is located substantially parallel with the central axis of the lens and can be located close to the central axis of the lens.

In the above-described exemplary vehicle lamp, the second focus line of the reflector, the optical axis of the light source and the central axis of the lens can be located on substantially the same virtual surface. The ellipsoidal reflex surface of the reflector can be divided into a plurality of ellipsoidal regions at a prescribed interval in the longitudinal direction and the other ones of the focuses of the ellipsoidal regions can be located on the second lines in order of the longitudinal direction. In addition, the lens can also be divided into a plurality of regions at a prescribed interval in the longitudinal direction so as to form a lens array, and each of imaginary surfaces that connect boundary lines of the regions of the lens to boundary lines of the ellipsoidal regions of the reflector in order of the longitudinal direction can be located substantially parallel with the optical axis of the light source with respect to each other. Moreover, the central axis of the lens can be a curved line.

According to the above-described exemplary vehicle lamp, the reflector can reflect light emitted from the light source toward the lens with a wide angle while the reflector keeps a short height as compared with a conventional vehicle lamp. Therefore, a light use efficiency of the light source can improve and an attachment structure of the vehicle lamp can become simple. In addition, various light sources such as a semiconductor light source, an HID lamp, a halogen bulb and the like can be used as the light source so as to match various vehicle lamps with substantially the same structure.

Furthermore, the second focus line of the ellipsoidal reflex surface of the reflector can be located substantially parallel with the central axis of the lens and close to the lens in the longitudinal direction of the lens. When each of light rays that converge at the second focuses of the ellipsoidal regions of the ellipsoidal reflex surface gets to each of the regions of the lens, each optical characteristic of the lights of the regions of the lens can be similar to each other. Thus, it is easy to control each of the light rays associated with the regions of the lens, and variations of light distributions between the regions of the lens can be reduced.

According to another aspect of the disclosed subject matter, a vehicle signal lamp can include a reflector having a first focus, a second focus line, and an opening that is formed in a slender shape, a light bulb (or other light source) having an optical axis and a convex lens having a central axis in the longitudinal direction of the reflector. The reflector can include a parabolic reflex surface in a longitudinal direction and an ellipsoidal reflex surface in a direction substantially perpendicular to the longitudinal direction. A focus of the parabolic reflex surface and one of focuses of the ellipsoidal reflex surface can be located at the first focus of the reflector, and other ones of the focuses of the ellipsoidal reflex surface can be located on the second focus line of the reflector. The light bulb or other light source can be located at the first focus of the reflector. In addition, the convex lens can be located at the opening of the reflector, wherein the second focus line of the reflector is located substantially parallel with the central axis of the convex lens and is located between the convex lens and the light bulb and close to the central axis of the lens, and the second focus line of the reflector, the optical axis of the light bulb and the central axis of the convex lens are located on substantially the same virtual surface.

In this case, a concave lens can also be used in place of the convex lens by changing a position of the second focus line of the reflector. The ellipsoidal reflex surface of the reflector can be divided into a plurality of ellipsoidal regions at a prescribed interval in the longitudinal direction and the other ones of the focuses of the ellipsoidal regions can be located on the second lines in order of the longitudinal direction. Moreover, the convex/concave lens can also be divided into a plurality of regions at a prescribed interval in the longitudinal direction so as to form a convex/concave lens array, and each of imaginary surfaces that connect boundary lines of the regions of the convex/concave lens to boundary lines of the ellipsoidal regions of the reflector in order of the longitudinal direction can be located substantially parallel with the optical axis of the light bulb with respect to each other. The central axis of the convex/concave lens can also be a curved line.

In the above-described vehicle signal lamp, because the structure of the reflector and the lens are substantially the same as the above-described vehicle lamp, the vehicle signal lamp using the light bulb can perform the features set forth above in paragraphs [0016]-[0017]. In addition, the lens can be formed in various shapes to match outside shapes of vehicles. Thus, the disclosed subject matter can provide vehicle signal lamps that can perform a favorable light distribution with high light use efficiency for various vehicles.

BRIEF DESCRIPTION OF THE DRAWINGS

These and other characteristics and features of the disclosed subject matter will become clear from the following description with reference to the accompanying drawings, wherein.

DETAILED DESCRIPTION OF EXEMPLARY EMBODIMENTS

Figure 1:
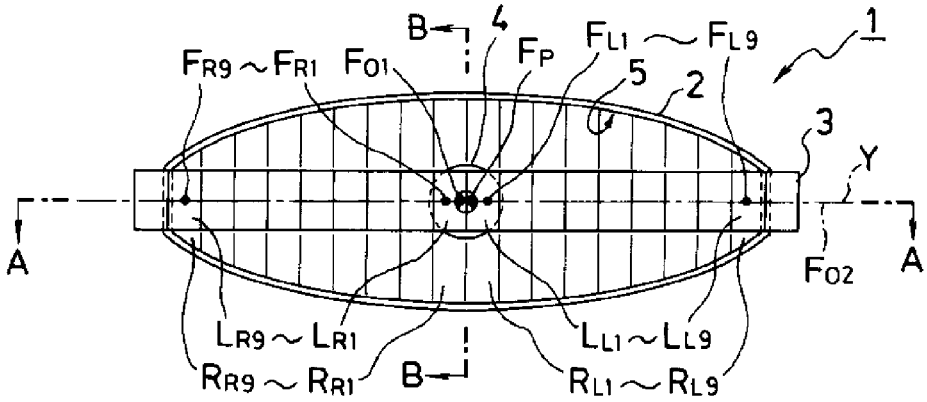
FIG. 1 is a front view showing an exemplary vehicle lamp made in accordance with principles of the disclosed subject matter.
Figure 2:
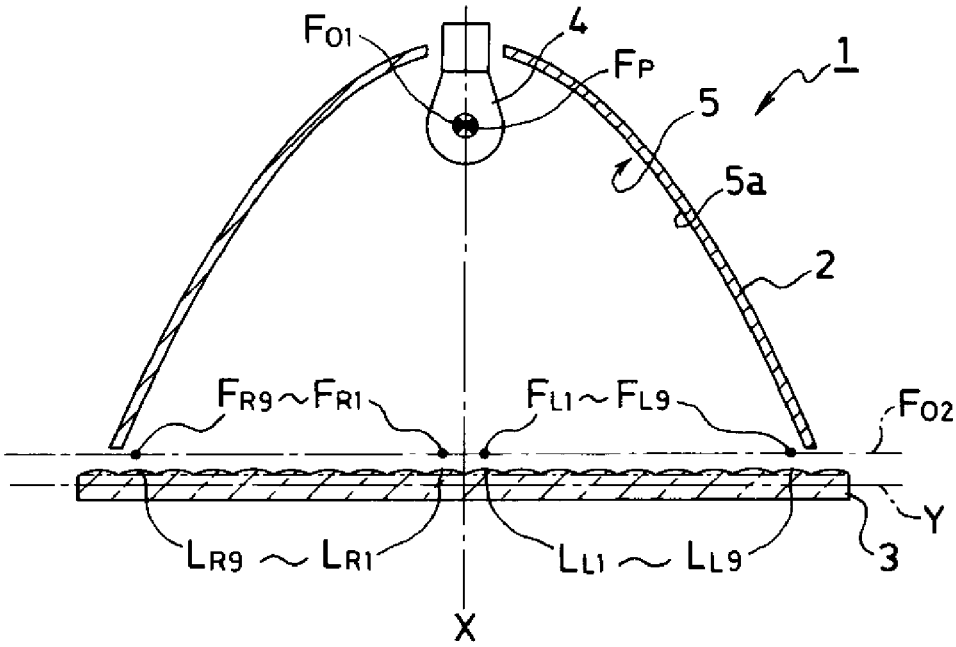
FIG. 2 is a cross-section view of the exemplary vehicle lamp taken along line A-A shown in FIG. 1.
Figure 3:
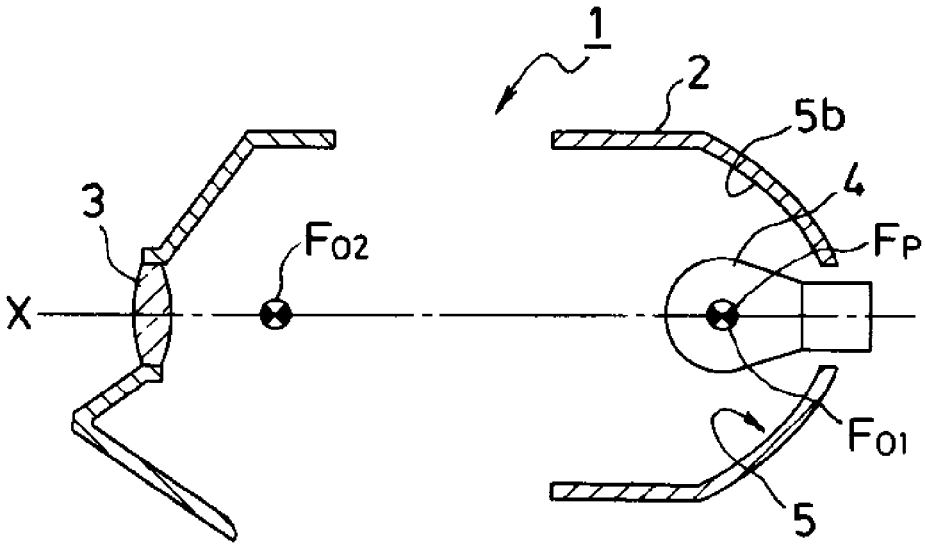
FIG. 3 is a cross-section view of the exemplary vehicle lamp taken along line B-B shown in FIG. 1.

The disclosed subject matter will now be described in detail with reference to FIG. 1 to FIG. 12. FIG. 1 is a front view showing an exemplary vehicle lamp made in accordance with principles of the disclosed subject matter. FIGS. 2 and 3 are cross-section views of the vehicle lamp taken along line A-A and line B-B shown in FIG. 1, respectively.

The vehicle signal lamp 1 can include: a reflector 2 having an opening, which is formed in a bowl shape, and an inner surface thereof including a reflex surface 5 that is formed in a slender shape; a light bulb 4 having an optical axis X and covered with the reflector 2 so as to be surrounded by the reflex surface 5 of the reflector 2; a lens 3 formed in a long and thin shape, the lens 3 being located at the opening of the reflector 2. A slender shape can be a shape in which the longitudinal direction is substantially larger than a direction perpendicular to the longitudinal direction.

The reflex surface 5 of the reflector 2 can be formed of a composite surface, which is composed of a parabolic surface and ellipsoidal surface. When the reflex surface 5 is shown in a cross-section view of a longitudinal direction (the cross-section taken along line A-A shown in FIG. 1) that intersects with the optical axis X of the light bulb 4 as shown in FIG. 2, the reflex surface 5 can include a parabolic reflex surface 5*a* of the cross-section shape having a focus Fp, which can be formed in a parabolic shape.

Figure 10:
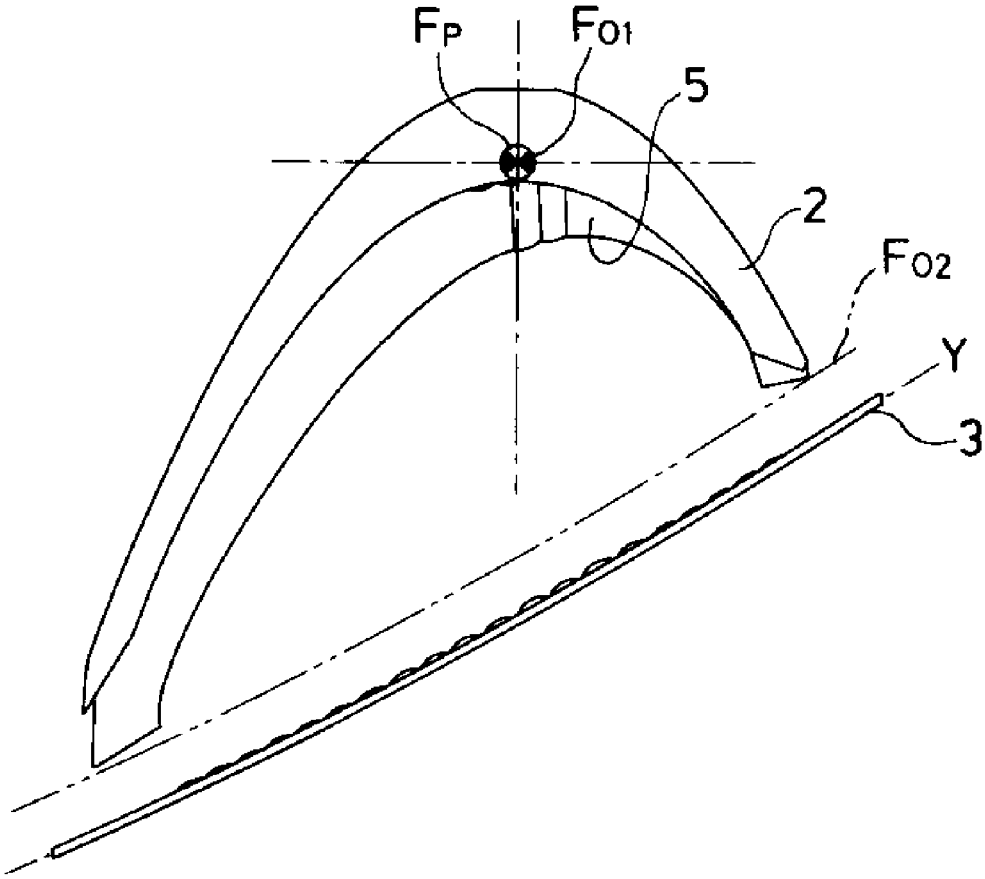
FIG. 10 is an explanatory diagram showing a first variation of shapes of a reflector and a lens made in accordance with principles of the disclosed subject matter.
Figure 11:
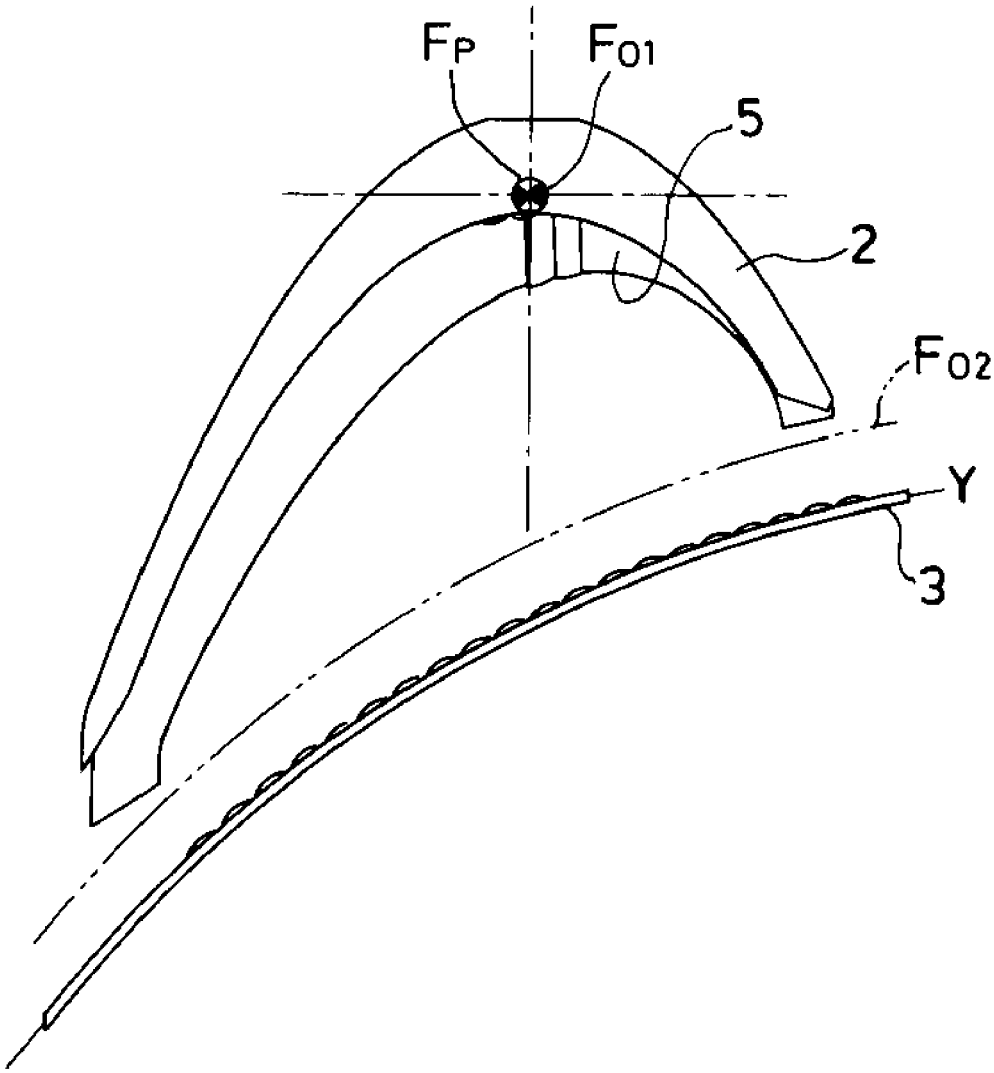
FIG. 11 is an explanatory diagram showing a second variation of the shapes of the reflector and the lens made in accordance with principles of the disclosed subject matter.
Figure 12:
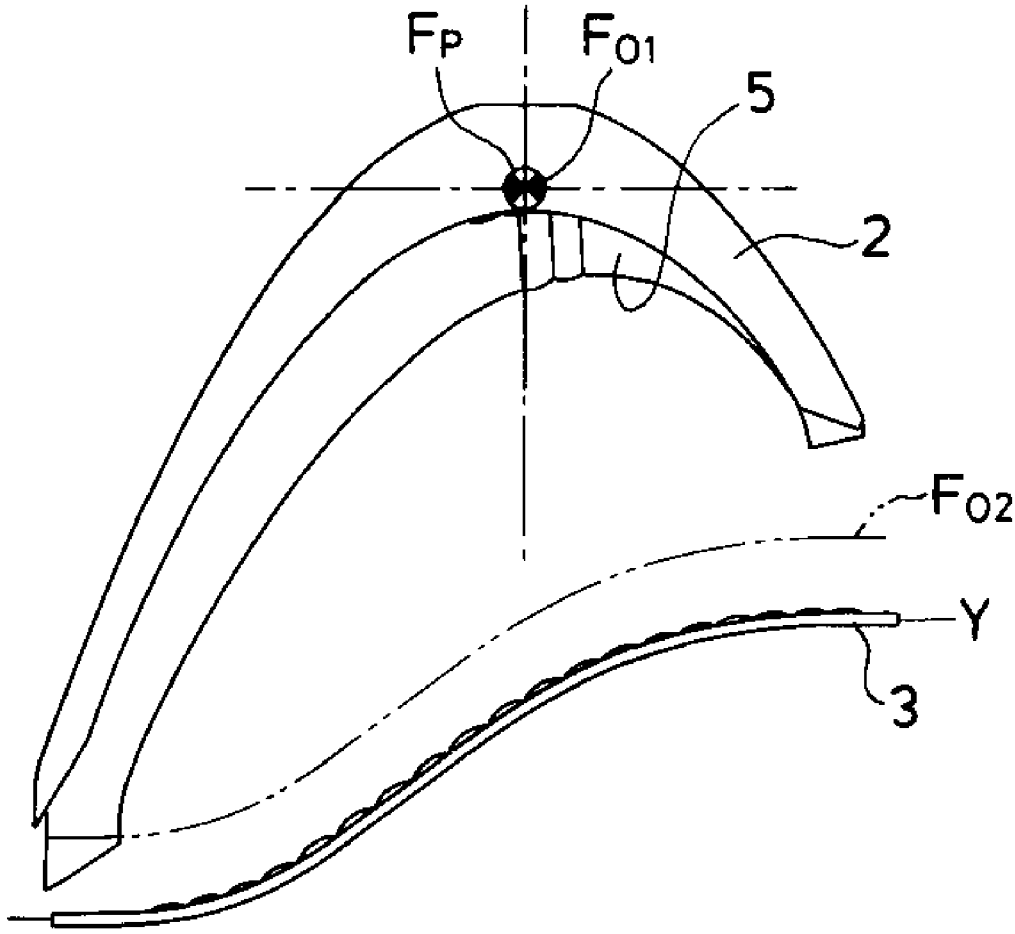
FIG. 12 is a an explanatory diagram showing a third variation of the shapes of the reflector and the lens made in accordance with principles of the disclosed subject matter.
Figure 13A:
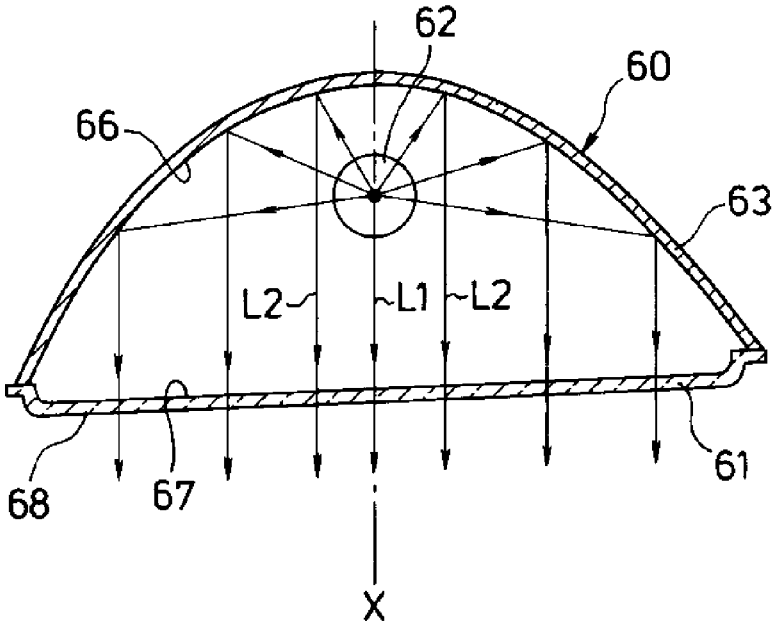
FIG. 13a Conventional Art
FIGS. 13*a* and 13*b* are a horizontal and vertical cross-section view depicting a structure for a conventional high mount stop lamp.
Figure 13B:
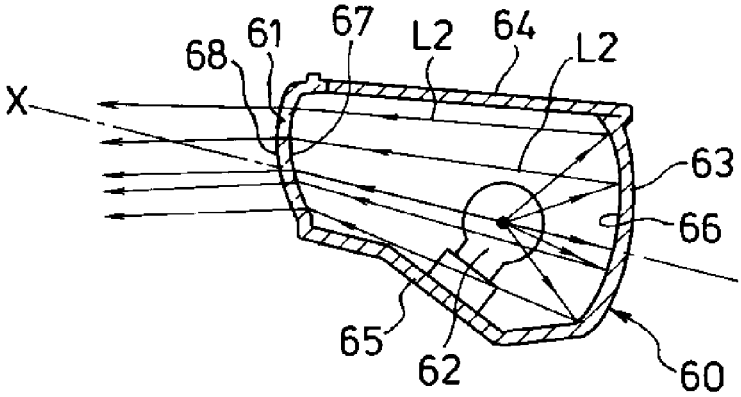
FIG. 13b Conventional Art

When the reflex surface 5 is shown in a cross-section view taken along line B-B that intersects with the optical axis X of the light bulb 4 at a right angle with respect to the line A-A (the longitudinal direction) as shown in FIG. 1, the reflex surface 5 can include an ellipsoidal reflex surface 5*b* of the cross-section shape having a first focus $F_{01}$ and a second focus line $F_{02}$, which can be formed in an ellipsoidal shape. In this case, the first focus $F_{01}$ of the ellipsoidal reflex surface 5*b* can substantially correspond to the focus Fp of the parabolic reflex surface 5*a*, and a filament of the light bulb 4 can also be located at the substantially first focus $F_{01}$ and focus Fp of the reflector surface 5. It should be noted that the second focus line $F_{02}$ can be shaped as a substantially straight line as viewed from a front of the lamp (FIG. 1) but can be substantially straight or curved as viewed from a top of the lamp, for example, as shown in FIGS. 10-12. In addition, the central axis of the lens 3 can extend along a longitudinal and central axis of the lens 3 as shown in FIGS. 1 and 2.

The lens 3 can be divided into a plurality of regions $L_{R1}$ to $L_{R9}$ and $L_{L1}$ to $L_{L9}$ at a prescribed interval in the longitudinal direction as shown in FIG. 2. A convex surface can be formed on each of the regions at an inner surface and/or an outer surface. Accordingly, the lens 3 can be composed of a tabular lens array that includes a central axis Y in the longitudinal direction thereof. In this case, the central axis Y of the lens 3 and the optical axis X of the light bulb 4 can be located on a substantially same virtual surface.

Therefore, the lens 3 can be located so that the central axis Y thereof can be included on the virtual surface including the optical axis X of the light bulb 4. The light bulb 4 can be located so that the filament of the light bulb 4 can be located at the focus Fp of the parabolic reflex surface 5*a* and at the first focus $F_{01}$ of the ellipsoidal reflex surface 5*b*. An example of the ellipsoidal reflex surface 5*b* will now be described in detail.

The ellipsoidal reflex surface 5*b* that is formed in the ellipsoidal shape can be divided into a plurality of ellipsoidal regions $R_{R1}$ to $R_{R9}$ and $R_{L1}$ to $R_{L9}$ at a prescribed interval in the longitudinal direction as shown in FIG. 1. Each of first focuses of the ellipsoidal regions $R_{R1}$ to $R_{R9}$ and $R_{L1}$ to $R_{L9}$ can be located at the first focus $F_{01}$ of the ellipsoidal reflex surface 5*b*, and second focuses of the ellipsoidal regions $R_{R1}$ to $R_{R9}$ and $R_{L1}$ to $R_{L9}$ can be located at $F_{R1}$ to $F_{R9}$ and $F_{L1}$ to $F_{L9}$ as shown in FIG. 2, respectively. The second focuses $F_{R1}$ to $F_{R9}$ and $F_{L1}$ to $F_{L9}$ can be located on the substantially second focus line $F_{02}$.

In other words, the first focuses of the plurality of ellipsoidal regions $R_{R1}$ to $R_{R9}$ and $R_{L1}$ to $R_{L9}$ can be located at the filament of the bulb 4, and each of the second focuses $F_{R1}$ to $F_{R9}$ and $F_{L1}$ to $F_{L9}$ of the ellipsoidal regions $R_{R1}$ to $R_{R9}$ and $R_{L1}$ to $R_{L9}$ can be located on the second focus line $F_{02}$ so that each of the second focuses $F_{R1}$ to $F_{R9}$ and $F_{L1}$ to $F_{L9}$ is different with respect to each other.

Each imaginary surface that connect each boundary line of the ellipsoidal regions $R_{R1}$ to $R_{R9}$ and $R_{L1}$ to $R_{L9}$ of the reflex surface 5 to each boundary line of regions $L_{R1}$ to $L_{R9}$ and $L_{L1}$ to $L_{L9}$ of the lens 3 can be substantially parallel with the optical axis X of the light bulb 4 and with respect to each other. Moreover, the second focus line $F_{02}$ that connects each of the second focuses $F_{R1}$ to $F_{R9}$ and $F_{L1}$ to $F_{L9}$ of the ellipsoidal regions $R_{R1}$ to $R_{R9}$ and $R_{L1}$ to $R_{L9}$ of the reflex surface 5 can be located on a virtual surface (i.e. planar surface) including the optical axis X of the bulb 4 and can be located close to the lens 3 so as to be substantially parallel to the central axis Y of the lens 3.

Figure 4:
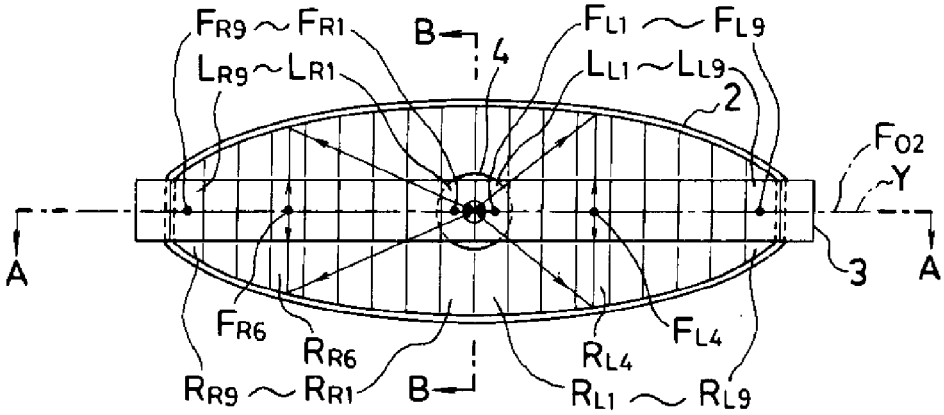
FIG. 4 is a front view showing a light ray trajectory of the exemplary vehicle lamp shown in FIG. 1.
Figure 5:
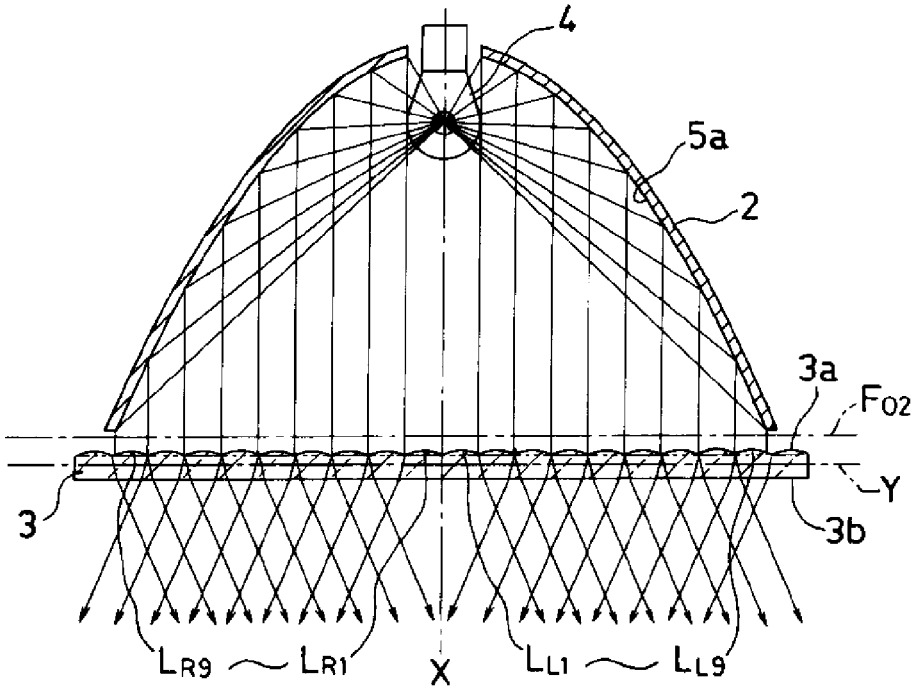
FIG. 5 is a cross-section view showing a light ray trajectory of the exemplary vehicle lamp shown in FIG. 2.
Figure 6:
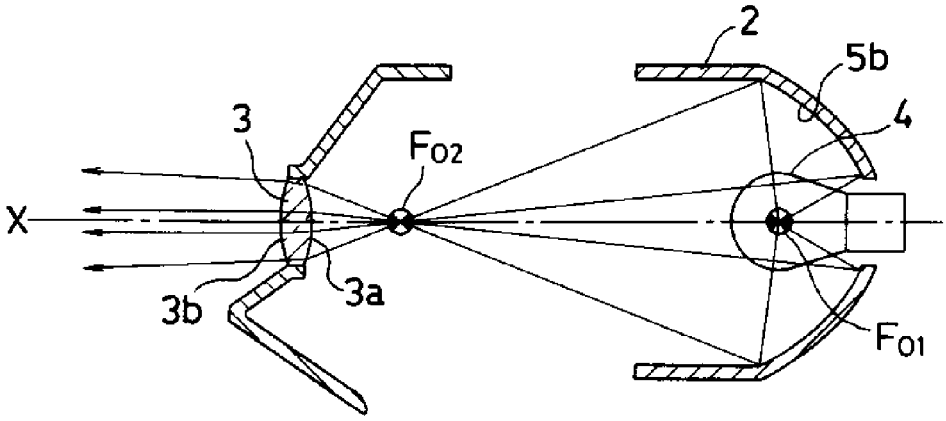
FIG. 6 is a cross-section view showing a light ray trajectory of the exemplary vehicle lamp shown in FIG. 3.

FIGS. 4 to 6 are front and cross-section views showing light ray trajectories of the vehicle signal lamp shown in FIGS. 1 to 3, respectively. In FIG. 4, for example, light reflected on a central portion of the ellipsoidal region $R_{R6}$ of the reflex surface 5 can pass through the second focus $F_{R6}$ of the ellipsoidal region $R_{R6}$ of the reflex surface 5 and can get to a central portion of region $L_{R6}$ of the lens 3. Similarly, light reflected on a central portion of the ellipsoidal region $R_{L4}$ of the reflex surface 5 can pass through the second focus $F_{L4}$ of the ellipsoidal region $R_{L4}$ of the reflex surface 5 and can get to a central portion of region $L_{L4}$ of the lens 3.

In FIG. 5, light emitted from the light bulb 4 toward the parabolic reflex surface 5*a* can be reflected on the parabolic reflex surface 5*a* and can move in parallel with the optical axis X of the light bulb 4. The light reflected on the parabolic reflex surface 5*a* can get to the inner surface 3*a* of the lens 3 and can enter into the lens 3 while it is refracted onto the inner surface 3*a* of the lens 3. Finally, the light that enters into the lens 3 can be illuminated in a direction toward a light-emission of the vehicle signal lamp 1 while it is controlled by the lens 3.

Light emitted from the light bulb 4 toward the ellipsoidal reflex surface 5*b* can be reflected on the ellipsoidal reflex surface 5*b* and can move to and from the second focus line $F_{02}$ including the second focuses $F_{R1}$ to $F_{R9}$ and $F_{L1}$ to $F_{L9}$ of the ellipsoidal regions $R_{R1}$ to $R_{R9}$ and $R_{L1}$ to $R_{L9}$ of the reflex surface 5 as shown in FIG. 6. The light that converges at the second focus line $F_{02}$ of the ellipsoidal reflex surface 5*b* can get to the inner surface 3*a* of the lens 3 and can enter into the lens 3 while it is refracted onto the inner surface 3*a* of the lens 3. Finally, the light that enters into the lens 3 can be illuminated in a direction toward the light-emission of the vehicle signal lamp 1 while it is controlled by the lens 3.

As describe above, the second focus line $F_{02}$ of the reflex surface 5 can be substantially parallel with the central axis Y of lens 3 and can be located close to the central axis Y in the longitudinal direction of the lens 3. When each of the light rays that converge at the second focuses $F_{R1}$ to $F_{R9}$ and $F_{L1}$ to $F_{L9}$ of the ellipsoidal regions $R_{R1}$ to $R_{R9}$ and $R_{L1}$ to $R_{L9}$ of the reflex surface 5 gets to each of the regions $L_{R1}$ to $L_{R9}$ and $L_{L1}$ to $L_{L9}$ of the lens 3, each optical characteristic of the light at the regions $L_{R1}$ to $L_{R9}$ and $L_{L1}$ to $L_{L9}$ of the lens 3 can be similar to each other.

Therefore, it is easy to control each of the light rays of the regions $L_{R1}$ to $L_{R9}$ and $L_{L1}$ to $L_{L9}$ of the lens 3, and variations of light distributions between the regions $L_{R1}$ to $L_{R9}$ and $L_{L1}$ to $L_{L9}$ of the lens 3 can be easily reduced by a computer simulation. Thus, the disclosed subject matter can provide various vehicle signal lamps having a favorable light distribution such as a stop lamp, a tail lamp, a turn signal lamp, etc.

Figure 7:
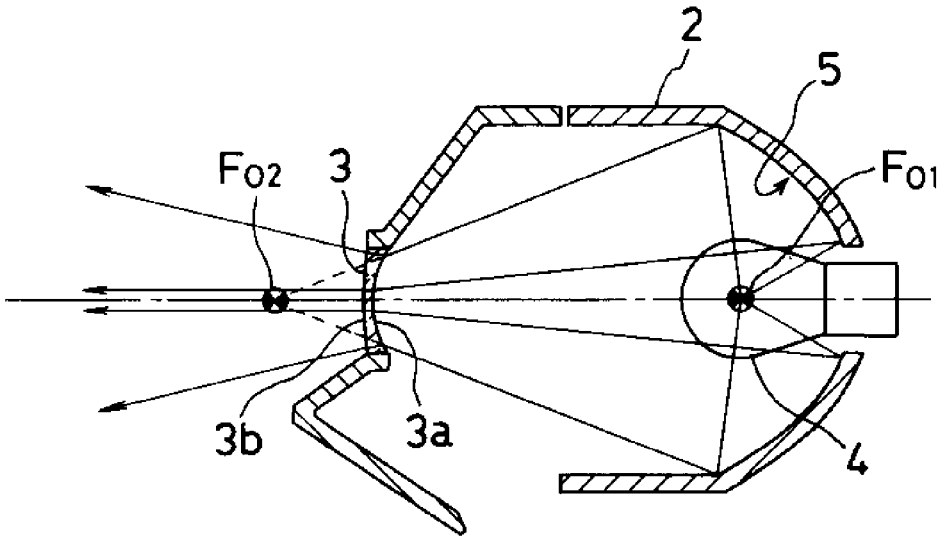
FIG. 7 is a cross-section view of another exemplary vehicle lamp made in accordance with principles of the disclosed subject matter.

In the above-described exemplary vehicle signal lamp, the lens 3 is described as a planar convex lens array, which divides into the plurality of regions at the prescribed interval in the longitudinal direction. However, a concave lens and the like can be used as the lens 3. FIG. 7 is a cross-section view of another exemplary vehicle lamp made in accordance with principles of the disclosed subject matter.

In the exemplary vehicle signal lamp of FIG. 7, the second focus line $F_{02}$ can be located close to the central axis Y of the lens 3 and can be located on a side opposite to a side of the lens 3 at which the light bulb 4 is located. Before light emitted from the light bulb 4 converges at the second focus line $F_{02}$ of the ellipsoidal reflex surface 5*b*, the light can get to the inner surface 3*a* of the concave lens 3 and can enter into the lens 3 while it is refracted onto the inner surface 3*a* of the lens 3. The light that enters into the lens 3 can pass from the outer surface 3*b* of the lens 3 in a direction toward the light-emission of the vehicle signal lamp 1 while it is controlled by the concave lens 3.

In the above-described exemplary embodiment, the combination of the ellipsoidal regions $R_{R1}$ to $R_{R9}$ and $R_{L1}$ to $R_{L9}$ of the reflex surface 5 and each of the regions $L_{R1}$ to $L_{R9}$ and $L_{L1}$ to $L_{L9}$ of the lens 3 can also result in a favorable light distribution of the vehicle signal lamp 1 because it is easy to control each of the lights of the regions $L_{R1}$ to $L_{R9}$ and $L_{L1}$ to $L_{L9}$ of the lens 3 and to reduce the variations of light distributions between the regions $L_{R1}$ to $L_{R9}$ and $L_{L1}$ to $L_{L9}$ of the lens 3. In addition, the disclosed subject matter can result in an improvement of the light use efficiency of the vehicle signal lamp 1.

Moreover, the above-described exemplary embodiment can allow the vehicle lamp 1 to further reduce the depth between the lens 3 and reflector 2 while it enables the lens 3 to diffuse light emitted from the light bulb 4. Furthermore, a free surface reflector can also be formed in place of the plurality of ellipsoidal regions $R_{R1}$ to $R_{R9}$ and $R_{L1}$ to $R_{L9}$ of the reflex surface 5. Therefore, the structure can be used for various vehicles such as a fog lamp, a daytime running lamp, etc.

Figure 8:
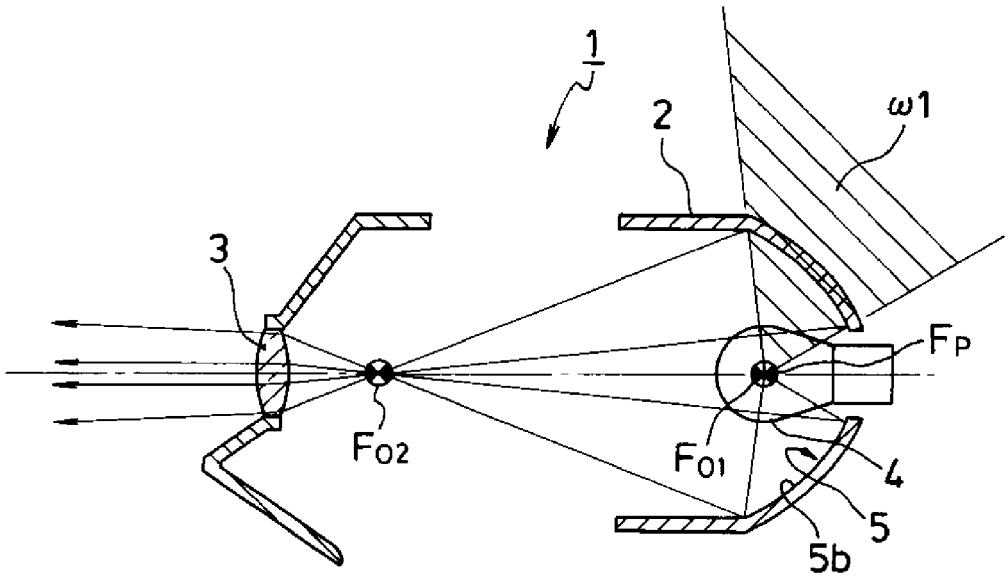
FIG. 8 is an explanatory cross-section view showing a solid angle with respect to an emitting light ray in the exemplary vehicle lamp of FIG. 7.
Figure 9:
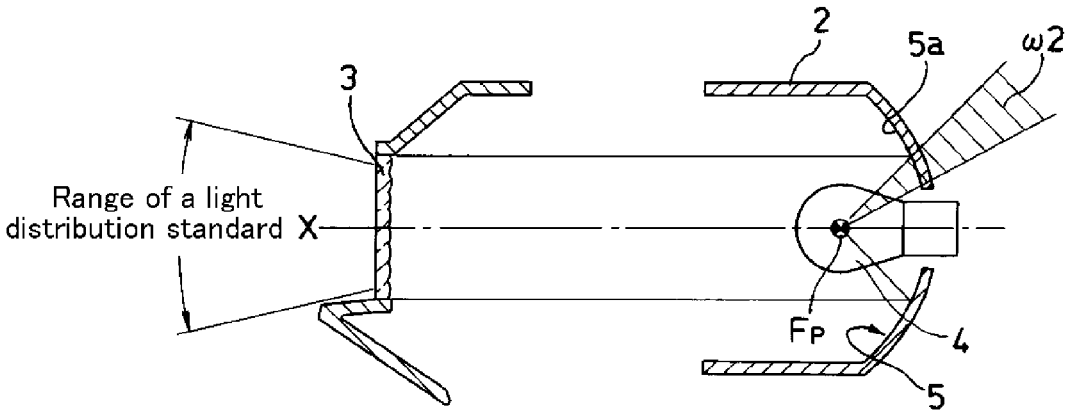
FIG. 9 is an explanatory cross-section view showing a solid angle with respect to an emitting light ray in a comparative vehicle signal lamp.

FIGS. 8 and 9 are explanatory cross-section views showing solid angles with respect to emitting rays in the vehicle signal lamp and a comparative vehicle signal lamp, respectively. Because the reflex surface 5 of the reflector 2 of the comparative lamp is formed only in a parabolic shape 5*a*, the solid angle for reflecting light on the reflex surface 5 is ω2 as shown in FIG. 9.

In contrast, the solid angle for reflecting light on the reflex surface 5 is col as shown in FIG. 8. Because the reflex surface 5*b* of the disclosed subject matter can be formed in an ellipsoidal shape in the direction perpendicular to the longitudinal direction, the reflected solid angle ω1 can be larger than the reflected solid angle ω2 of the lamp of FIG. 9. Thus, the disclosed subject matter can result in the improvement of the light use efficiency of the vehicle signal lamp 1, and therefore can provide various vehicle lamps having a favorable light distribution.

An outside shape of the vehicle lamp, especially, the outer surface 3*b* of the lens 3 can be considered a part of an outside appearance of a vehicle. Accordingly, a shape of the lens 3 may change in accordance with the outside shape of the vehicle. In this case, when the second focus line $F_{01}$ of the ellipsoidal reflex surface 5*b* is located close to the central axis Y of the lens 3 and is substantially parallel with the central axis Y, effects of the disclosed subject matter can be obtained even if the shape of the lens 3 changes.

FIGS. 10 and 11 are explanatory diagrams showing a first and second variation of shapes of the reflector 2 and the lens 3 made in accordance with principles of the disclosed subject matter, respectively. A curved reflector 2 in the longitudinal direction and a lens 3 formed in a convex shape in the longitudinal direction can be used for various vehicle lamps including the vehicle signal lamp 1 as show in FIG. 10. Similarly, the curved reflector 2 in the longitudinal direction and a lens 3 formed in a concave shape in the longitudinal direction can also be used for various vehicle lamps.

FIG. 12 is an explanatory diagram showing a third variation of the shapes of the reflector 2 and the lens 3. A lens 3 formed in a wave shape in the longitudinal direction and the curved reflector 2 in which second focus line $F_{02}$ is located in substantially parallel with the central axis Y of the lens 3 can also be used for various vehicle lamps including the vehicle signal lamp 1 to match outside shapes of the vehicles.

Various modifications of the above disclosed embodiments can be made without departing from the spirit and scope of the presently disclosed subject matter. For example, the above-described light source is not limited to a light bulb, and various light sources such as a semiconductor light source, a HID lamp, a halogen bulb and the like can be used as the light source.

While there has been described what are at present considered to be exemplary embodiments of the invention, it will be understood that various modifications may be made thereto, and it is intended that the appended claims cover such modifications as fall within the true spirit and scope of the invention. All conventional art references described above are herein incorporated in their entirety by reference.

What is claimed is:

1. A vehicle lamp, comprising:

a reflector having a first focus, a second focus line, and an opening formed in a slender shape, the reflector including a parabolic reflex surface extending in a longitudinal direction, a focus of the parabolic reflex surface located at the first focus, the reflector including an ellipsoidal reflex surface extending in a direction substantially perpendicular to the longitudinal direction, the ellipsoidal reflex surface including a first ellipsoidal focus located at the first focus, and other ellipsoidal focuses of the ellipsoidal reflex surface located on the second focus line;

a light source having an optical axis and located at the first focus of the reflector; and a lens having a central axis extending parallel with the longitudinal direction of the reflector and located at the opening of the reflector, wherein the second focus line of the reflector is substantially parallel with the central axis of the lens and is located adjacent the central axis of the lens.

2. The vehicle lamp according to claim 1, wherein the second focus line of the reflector, the optical axis of the light source, and the central axis of the lens are located on a substantially same virtual surface.

3. The vehicle lamp according to claim 2, wherein the ellipsoidal reflex surface of the reflector is divided into a plurality of ellipsoidal regions at a prescribed interval in the longitudinal direction and the other ellipsoidal focuses of the ellipsoidal regions are located on the second line in order along the longitudinal direction.

4. The vehicle lamp according to claim 3, wherein the lens is divided into a plurality of regions at a prescribed interval along the longitudinal direction so as to form a lens array, and each imaginary surface that connects a boundary line of the regions of the lens to a respective boundary line of the ellipsoidal regions of the reflector in order along the longitudinal direction is substantially parallel with the optical axis of the light source and with respect to each other.

5. The vehicle lamp according to claim 2, wherein the lens is divided into a plurality of regions at a prescribed interval along the longitudinal direction so as to form a lens array.

6. The vehicle lamp according to claim 2, wherein the central axis of the lens is a curved line.

7. The vehicle lamp according to claim 1, wherein the ellipsoidal reflex surface of the reflector is divided into a plurality of ellipsoidal regions at a prescribed interval in the longitudinal direction and the other ellipsoidal focuses of the ellipsoidal regions are located on the second line in order along the longitudinal direction.

8. The vehicle lamp according to claim 7, wherein the lens is divided into a plurality of regions at a prescribed interval along the longitudinal direction so as to form a lens array, and each imaginary surface that connects a boundary line of the regions of the lens to a respective boundary line of the ellipsoidal regions of the reflector in order along the longitudinal direction is substantially parallel with the optical axis of the light source and with respect to each other.

9. The vehicle lamp according to claim 1, wherein the lens is divided into a plurality of regions at a prescribed interval along the longitudinal direction so as to form a lens array.

10. The vehicle lamp according to claim 1, wherein the central axis of the lens is a curved line.

11. A vehicle signal lamp, comprising:

a reflector having a first focus, a second focus line, and an opening formed in a slender shape, the reflector including a parabolic reflex surface extending in a longitudinal direction, a focus of the parabolic reflex surface located at the first focus, the reflector including an ellipsoidal reflex surface extending in a direction substantially perpendicular to the longitudinal direction, the ellipsoidal reflex surface including a first ellipsoidal focus located at the first focus, and other ellipsoidal focuses of the ellipsoidal reflex surface located on the second focus line;

a light bulb having an optical axis and located at the first focus of the reflector; and a convex lens having a central axis extending in the longitudinal direction of the reflector and located at the opening of the reflector, wherein the second focus line of the reflector is substantially parallel with the central axis of the convex lens and is located between the convex lens and the light bulb and adjacent the central axis of the lens, and the second focus line of the reflector, the optical axis of the light bulb, and the central axis of the convex lens are located on a substantially same virtual surface.

12. The vehicle signal lamp according to claim 11, wherein the ellipsoidal reflex surface of the reflector is divided into a plurality of ellipsoidal regions at a prescribed interval in the longitudinal direction and the other ellipsoidal focuses of the ellipsoidal regions are located on the second line in order along the longitudinal direction.

13. The vehicle signal lamp according to claim 12, wherein the convex lens is divided into a plurality of regions at a prescribed interval along the longitudinal direction so as to form a convex lens array, and each imaginary surface that connects a boundary line of the regions of the convex lens to a respective boundary line of the ellipsoidal regions of the reflector in order along the longitudinal direction is substantially parallel with the optical axis of the light bulb and with respect to each other.

14. The vehicle signal lamp according to claim 11, wherein the convex lens is divided into a plurality of regions at a prescribed interval along the longitudinal direction so as to form a convex lens array.

15. The vehicle signal lamp according to claim 11, wherein the central axis of the convex lens is a curved line.

16. A vehicle signal lamp, comprising:

a reflector having a first focus, a second focus line and an opening formed in a slender shape, the reflector including a parabolic reflex surface extending in a longitudinal direction, a focus of the parabolic reflex surface located at the first focus, the reflector including an ellipsoidal reflex surface extending in a direction substantially perpendicular to the longitudinal direction, the ellipsoidal reflex surface including a first ellipsoidal focus located at the first focus, and other ellipsoidal focuses of the ellipsoidal reflex surface located on the second focus line;

a light bulb having an optical axis located at the first focus of the reflector; and a concave lens having a central axis extending in the longitudinal direction of the reflector and located at the opening of the reflector, wherein the second focus line of the reflector is substantially parallel with the central axis of the concave lens and the concave lens is located between the second focus line and the light bulb, and the second focus line is located adjacent the central axis of the concave lens, the optical axis of the light bulb and the central axis of the concave lens are located on a substantially same virtual surface.

17. The vehicle signal lamp according to claim 16, wherein the ellipsoidal reflex surface of the reflector is divided into a plurality of ellipsoidal regions at a prescribed interval in the longitudinal direction and the other ellipsoidal focuses of the ellipsoidal regions are located on the second line in order along the longitudinal direction.

18. The vehicle signal lamp according to claim 17, wherein the concave lens is divided into a plurality of regions at a prescribed interval along the longitudinal direction so as to form a concave lens array, and each imaginary surface that connects a boundary line of the regions of the concave lens to a respective boundary line of the ellipsoidal regions of the reflector in order along the longitudinal direction is substantially parallel with the optical axis of the light bulb and with respect to each other.

19. The vehicle signal lamp according to claim 16, wherein the concave lens is divided into a plurality of regions at a prescribed interval along the longitudinal direction so as to form a concave lens array.

20. The vehicle signal lamp according to claim 16, wherein the central axis of the concave lens is a curved line.

* * * * *